US010405104B1

(12) United States Patent
Abel

(10) Patent No.: US 10,405,104 B1
(45) Date of Patent: Sep. 3, 2019

(54) RIBBON ARRAY MICROPHONE

(76) Inventor: Jonathan S. Abel, Menlo Park, CA (US)

( * ) Notice: Subject to any disclaimer, the term of this patent is extended or adjusted under 35 U.S.C. 154(b) by 945 days.

(21) Appl. No.: 13/224,263

(22) Filed: Sep. 1, 2011

Related U.S. Application Data

(60) Provisional application No. 61/379,342, filed on Sep. 1, 2010.

(51) Int. Cl.
*H04R 19/04* (2006.01)
*H04R 29/00* (2006.01)

(52) U.S. Cl.
CPC ..... *H04R 19/04* (2013.01); *H04R 29/005* (2013.01)

(58) Field of Classification Search
CPC ..... H04R 19/04; H04R 29/005
USPC ..... 381/173–174, 176, 399, 111, 113, 116, 381/190–191, 423; 367/152
See application file for complete search history.

(56) References Cited

U.S. PATENT DOCUMENTS 5,748,758 A * 5/1998 Menasco et al. ..... 381/176
6,434,252 B1 * 8/2002 Royer ..... H04R 9/048 381/176
8,472,651 B2 * 6/2013 Pompei ..... 381/191

* cited by examiner

*Primary Examiner* — Sunita Joshi
(74) *Attorney, Agent, or Firm* — Foley & Lardner LLP

(57) ABSTRACT

The invention includes a basic approach to simulate the workings of a ribbon microphone based on measurements at an array of more robust small pressure microphones. Embodiments of the invention take an array of microphone elements, either very small microphones that are placed on either side of a printed circuit board or some other device to understand the sound pressure differences from front to back and use those sound pressure differences to emulate the motion of a ribbon if a ribbon were co-located with the array of microphones. The microphone array detects differential pressure, either by a set of elements that that have figure of eight polar patterns, or by having separate elements front and back.

15 Claims, 17 Drawing Sheets

RIBBON ARRAY MICROPHONE

CROSS-REFERENCE TO RELATED APPLICATIONS

The present application claims priority to U.S. Provisional Application No. 61/379,342, filed Sep. 1, 2010, the contents of which are incorporated by reference herein in their entirety.

FIELD OF THE INVENTION

In general, the invention is related to audio processing, and in particular to an emulation of a ribbon microphone.

BACKGROUND OF THE INVENTION

Ribbon microphones are known for their sort of warm natural sonics. They have really desirable characteristics especially for things like vocals. And, what they do, they consist of a ribbon which is a very, very thin corrugated sheet of aluminum that is suspended in a magnetic field. Incoming sound waves cause the ribbon to vibrate, moving conductor in a magnetic field will generate a voltage across the conductor and be an indicator of the sound field. So there are a number of manufacturers, probably the most famous initial group of microphones is made by RCA.

FIGS. 1A and 1B illustrate a couple of conventional ribbon microphones. These are a couple of classics by RCA. Personnel at RCA invented the ribbon microphone. The RCA-44 is shown—labeled 1101 and the RCA-77 is labeled 1102. Also shown is a figure from one of their early patents, that shows a think corrugated strip of aluminum labeled 1105 suspended in a magnetic field created by the magnet 1104. So, sound impinging on this strip will cause it to vibrate. It's conductive. A moving conductor in a magnetic field will develop a voltage across its terminals and this voltage will represent the sound field and that's the voltage that gets sent to a delay transformer and then on to a preamp and then onto whatever the recording engineers wants to do with it.

So, these ribbon microphones are really quite desirable for a number of applications. People use them for vocals, they use them for horns and the like. They have a natural warm sound that is desirable. They have also a strong polar pattern. As can be appreciated, the ribbon will move in response to pressure difference between the front of the ribbon and the back of the ribbon and therefore sound arriving from the side of the ribbon will not produce an output whereas sound coming from the front or back will produce a relatively loud output.

FIG. 1B shows a detail of a ribbon microphone, in which a couple of magnets 1106, have a ribbon, this thin corrugated strip of aluminum 1107 suspended between them. Presumably the south pole of one of the bar magnets is opposite the north pole of the other. So, these ribbon microphones are very delicate, mechanically and acoustically. The ribbons are very thin and really designed such that if their molecules are moving back and forth, the ribbon is just going to move back and forth with them. They are suspended with very little tension. In fact, if one were to tilt a ribbon microphone onto its side, if one could take off the various wind screens etc., one would see that that the ribbon will sort of sag under force of gravity. If one were to blow on a ribbon microphone it would break. Some repairs to the ribbon, if that were possible, would be needed. However, if one wanted to have a working microphone, a new ribbon would more likely be needed. So, this sensitivity to acoustics, as well as the mechanical sensitivity inherent in these microphones, does limit their use. They are not likely to be used on a kick drum for instance. However, they do get used for vocals and horns and the like. They probably are not going to be used in a lodge setting. So, they have a few drawbacks in terms of their mechanical and acoustic robustness, so they also have low output levels and these things limit their usage.

The housings in the microphones shown in FIG. 1A are designed such that the polar pattern has been changed into a cartoid pattern. Once nice thing about ribbon microphones is that they have a very strong polar pattern. Differential sound pressure front to back will cause the ribbon to be moved in that transverse direction so that sounds coming from the front or back will displace the ribbon where a sound is coming from the side present no differential pressure to the ribbon and it is not displaced. So you have null coming out the sides which can be used to put a couple horn players in front of a couple of ribbon microphones and have one horn player placed in the null of the other horn player's microphone and vice versa.

The issues with conventional ribbon microphones include that they are very delicate, mechanically and acoustically. If one were to blow onto the ribbon it would deform and it would not be able to be put back to its original shape. They definitely cannot be dropped without being damaged. Also, their output levels are not up to standard. So, there are some businesses that manufacture these microphones today but they are expensive, and they are not very mechanically and acoustically robust, so they are not the kind of thing that an unsophisticated user could handle and they are not the kind of thing useful for drums or instruments that are super loud. They are not suited to being used for live performances. There are limited places that they can be used even though they have a desirable sound.

FIGS. 5A and 5B show a photograph and a couple of mechanical drawings of microphones from Beyerdynamic, respectively. In FIG. 5B, there is a 1930 vintage ribbon microphone showing a corrugated aluminum strip 1201 suspended in a magnetic field created by magnet 1202. The corrugations on this microphone are generally perpendicular to its axis. There are a couple of microphones 1203 and 1204 that have corrugations going between the points that the ribbon is suspended. The photograph in FIG. 5A shows the ribbon inside a housing and 1205 would likely be the mounting for the housing of the ribbon and 1206 shows the actual ribbon. This ribbon has a couple corrugations that are perpendicular to its length and then several corrugations that are along its length. The idea is that the corrugations will make the microphone stiff on that one axis. This microphone was put in a housing that would create a time delay between signals arriving from the back and arriving from the front and as a result of that the polar pattern for this particular microphone is not a classic figure of eight, it's more of a cartoid pattern.

A BBC engineering monograph by D. E. L. Shorter and H. D. Hardwood entitled "The Design of a Ribbon Type Pressure-Gradient Microphone for Broadcast Transmission" (1955) describes a number of technical aspects of the ribbon microphones in terms of anything from their frequency response to various mechanical details, as well as images of the insides of several microphones showing their construction.

SUMMARY OF THE INVENTION

In general, the invention includes a basic approach to simulate the workings of a ribbon microphone based on measurements at an array of more robust small pressure microphones.

According to some aspects, embodiments of the invention take an array of microphone elements, either very small microphones that are placed on either side of a printed circuit board or some other device to understand the sound pressure differences from front to back and use those sound pressure differences to emulate the motion of a ribbon if a ribbon were co-located with the array of microphones. So the microphone array detects differential pressure, either by a set of elements that that have figure of eight polar patterns, or by having separate elements front and back. Embodiments of the invention detect differential pressure, either along an area, for example a two-dimensional grid or a single line array of differential pressure elements, or two rows of elements that provide an understanding of the dynamics of the ribbon microphone in terms of both a transverse displacement and a tortional displacement. An aspect of the invention is to take the microphones' signals, which indicate differential pressure front to back, and use those differential pressures to drive an emulation of the ribbon using an emulation of the ribbon motion—it's displacement has a function of position along the ribbon and time—from which the voltage developed across the ribbon can be determined. As the ribbon moves in a simulated magnetic field, the voltage that develops across the ribbon is then used to drive the electronics which result in the output. So an aspect of the invention is to use that array of microphones to simulate the motion of the ribbon and the electromagnetics and electronics to develop an output which would be very much like the output of an actual ribbon microphone. The difference is that the microphone elements that are used would be mechanically robust, they would be acoustically robust—perhaps something that could be used in a live setting where there is a lot of mechanical shock, sweat, etc.—and therefore alleviate some of the drawbacks of the ribbon microphone in terms of its handling usage, generating a normal output level, etc., but at the same time maintaining the desirable sonics of the ribbon microphone.

According to further aspects, the invention has several components. One component has to do with simulating the motion of the ribbon. Another component has to do with simulating the electromagnetics—in other words the conductor moving in the magnetic field. And, another component has to do with the simulating of the electronics.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

According to certain general aspects, the invention aims to create a microphone that has the sonic properties of a ribbon microphone, but is mechanically robust and produces a good solid electrical output and is acoustically robust. One general idea is to sample the sound field at a number of points along a hypothetical ribbon. So, using an array of small microphones, embodiments of the invention sample the sound field at those different points and use the array microphone signals to drive a simulation of the motion of the ribbon. Given a simulation of the motion of the ribbon, and using some mathematics that describe the voltage that would develop across the ribbon, additional mathematics can be performed to produce the resulting microphone output.

Figure 1A:
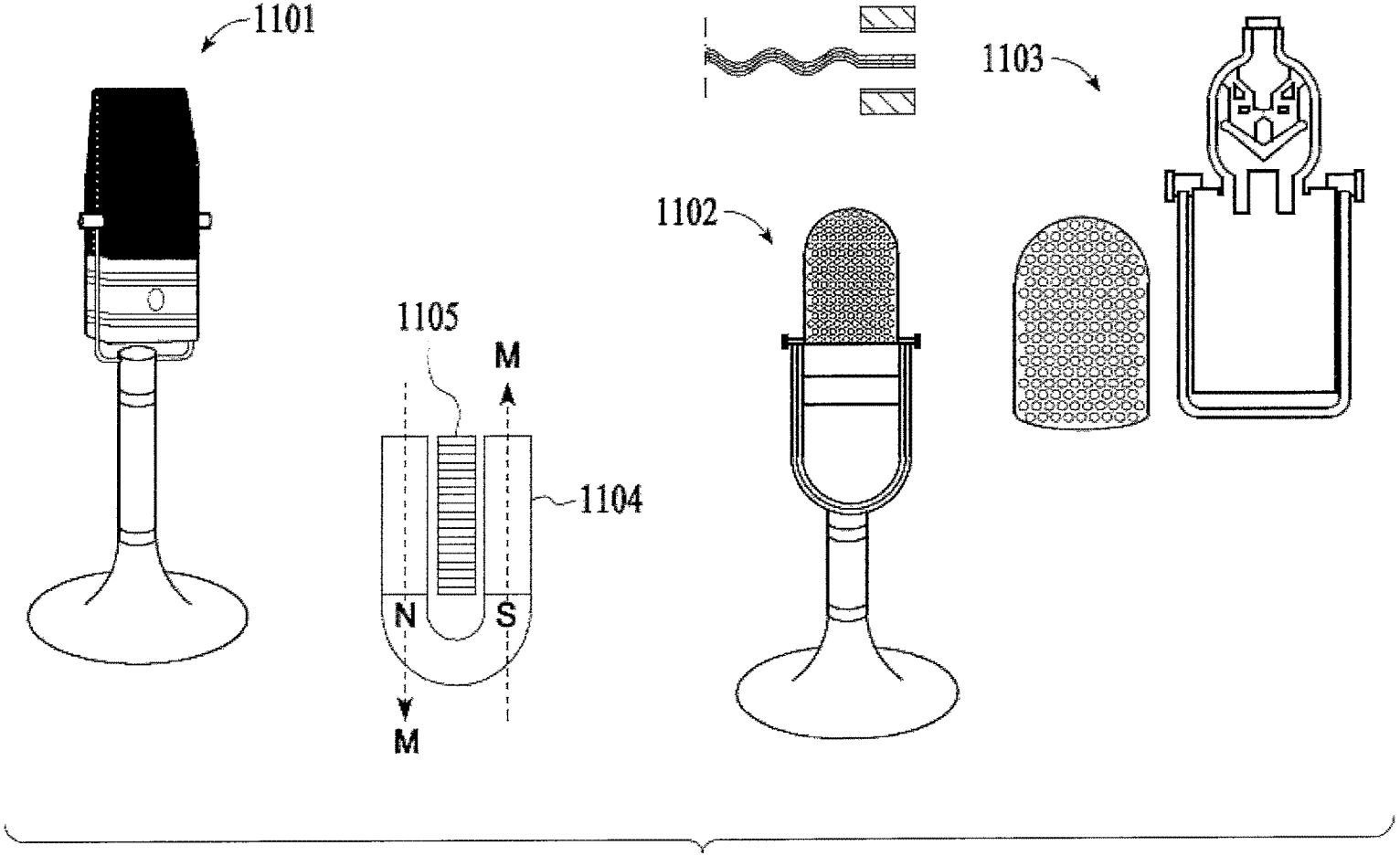
FIG. 1A (PRIOR ART)
FIGS. 1A and 1B illustrate conventional ribbon microphones.
Figure 1B:
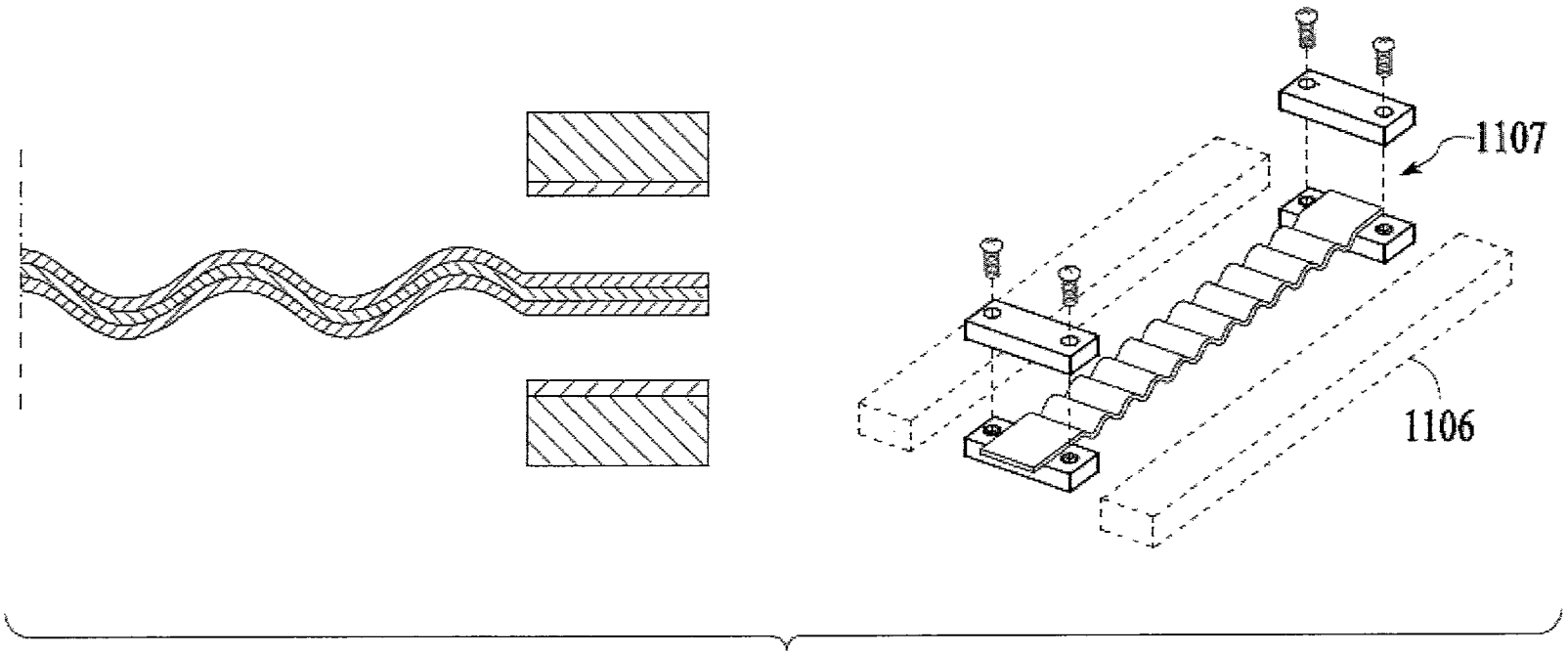
FIG. 1B (PRIOR ART)
Figure 2A:
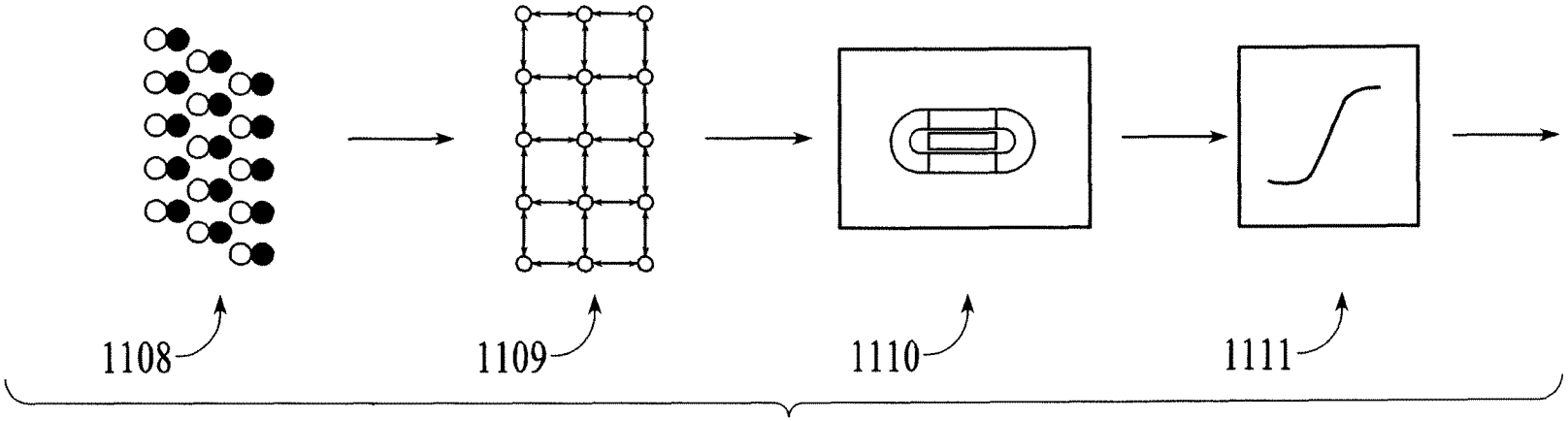
FIGS. 2A and 2B illustrates aspects of array microphones according to the invention.

One example of how this can be done is shown in FIG. 2A. In FIG. 2A there is shown a microphone array 1108 driving a waveguide mesh 1109. The waveguide mesh or finite different schemes or other approaches can be used to predict the motion of the ribbon in response the sound field appearing at the elements in the microphone array. Given the motion of the ribbon, a process 1110 could be used to emulate the voltage across the ribbon in response to its motion in the magnetic field that it is suspended in and then the output of the electromagnetics process can drive a system that produces the microphone output 1111.

There can be some interaction among these different elements. For instance as a conductor moves in a magnetic field, currents will develop that will actually cause a force opposing the motion. Similarly, voltage develops across the terminals of a microphone, it drives some electronics depending on what electronics it is seeing, the voltage might be altered. But an aspect of the invention is to use mechanically and acoustically robust small microphone elements in an array to drive a process which will simulate the sonics of the ribbon microphone. And, because these microphone elements can be very inexpensive, small cartridge elements, etc., and because these elements can be made to be very mechanically and acoustically robust, this approach could possibly be used to create a microphone that sounds like a ribbon microphone but would have much wider application and be much less expensive to manufacture and maintain.

Figure 2B:
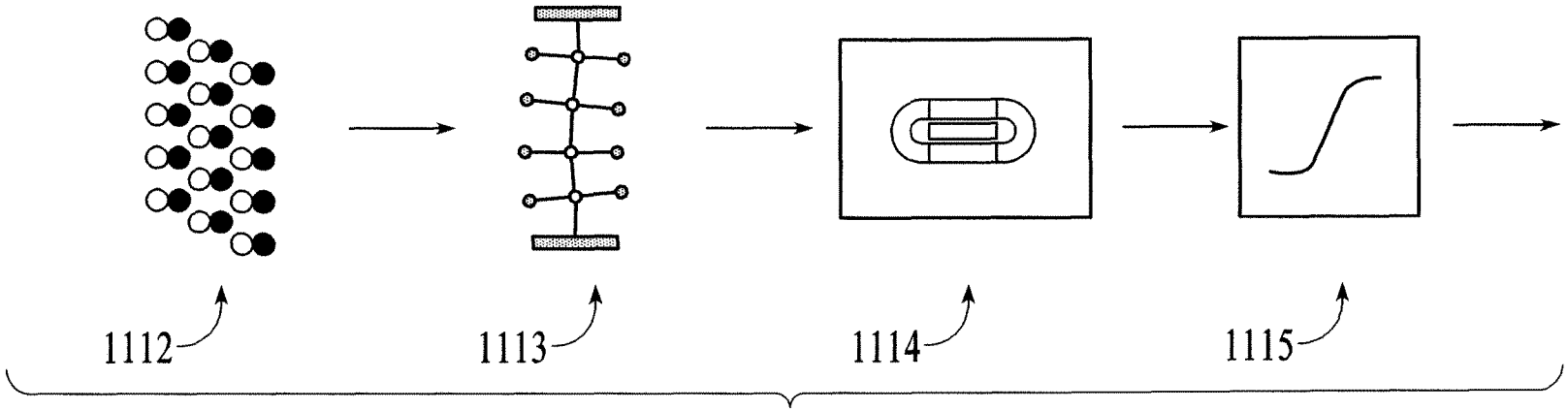

FIG. 2B illustrates another example system according to the invention. In FIG. 2B there is shown a microphone array 1112, a ribbon dynamics section 1113, electromagnetics 1114, and electronics 1115. One difference between this example system and the previous one is in the ribbon dynamics. One can use techniques such as waveguide mesh or finite difference, finite element methods to generate the motion of the ribbon in response to the sound field detected by the microphone array, but there are other techniques that can be used as well. For example, this can be done using a laser vibrometer. Experiments performed by the present inventor using a laser vibrometer show that the ribbon only exhibits certain kinds of motion and so a simpler dynamics model, to be described in more detail below, can be used.

Figure 3:
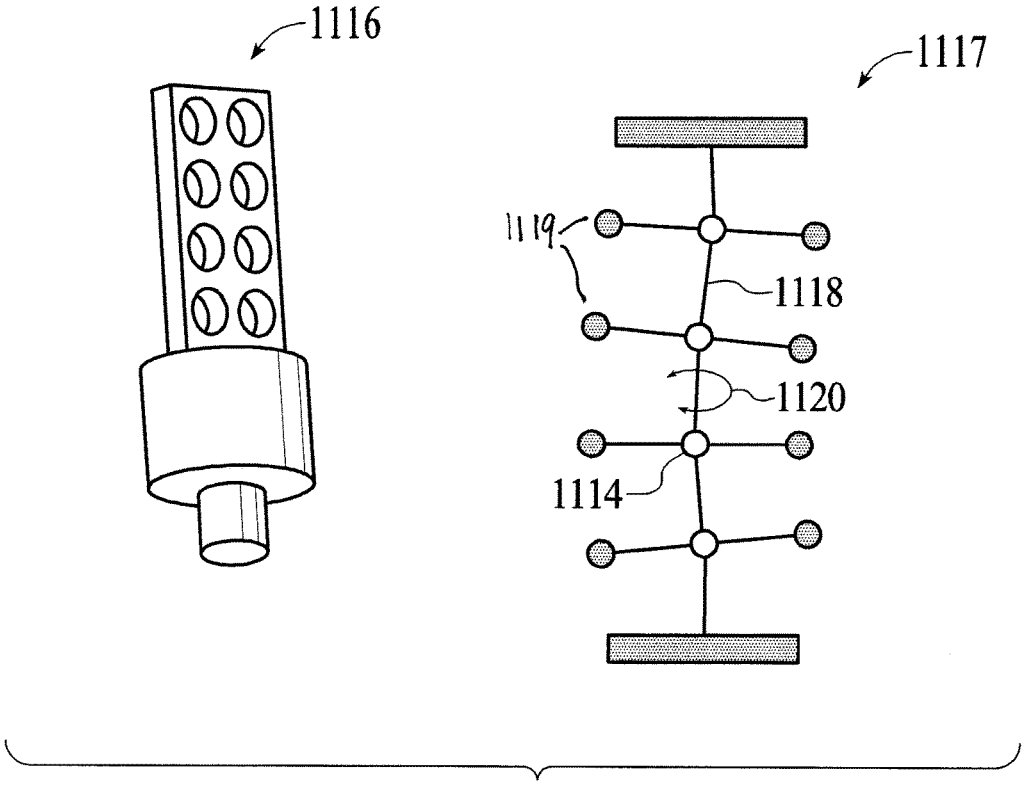
FIG. 3 illustrates aspects of array microphones according to the invention.

FIG. 3 illustrates one example implementation of the invention. In this example, there is a holder 1116 that includes spaces for eight microphone cartridges in a 4 by 2 array of microphones. In embodiments, these cartridges include KE-10 microphones which are 10 mm diameter Sendheiser microphones with a figure of 8 polar pattern. According to certain aspects, this provides two pressure microphones back to back with the output being the difference between the two so that a signal arriving from the side will not produce any pressure difference and not produce any output signal arriving from the front or back will generate an output. So, the holder is fabricated to populate it with microphones and those are the microphones that are going to drive a dynamics according to a model of the ribbon dynamics.

As further shown in FIG. 3, this model 1117, an alternative to the waveguide mesh, comprises a set of springs 1118 connected to masses 1119, the position and orientation of which are being driven by the arriving sound field and some parameterization of the characteristics of the ribbon, including its material, its geometry thickness, etc.

Figure 4:
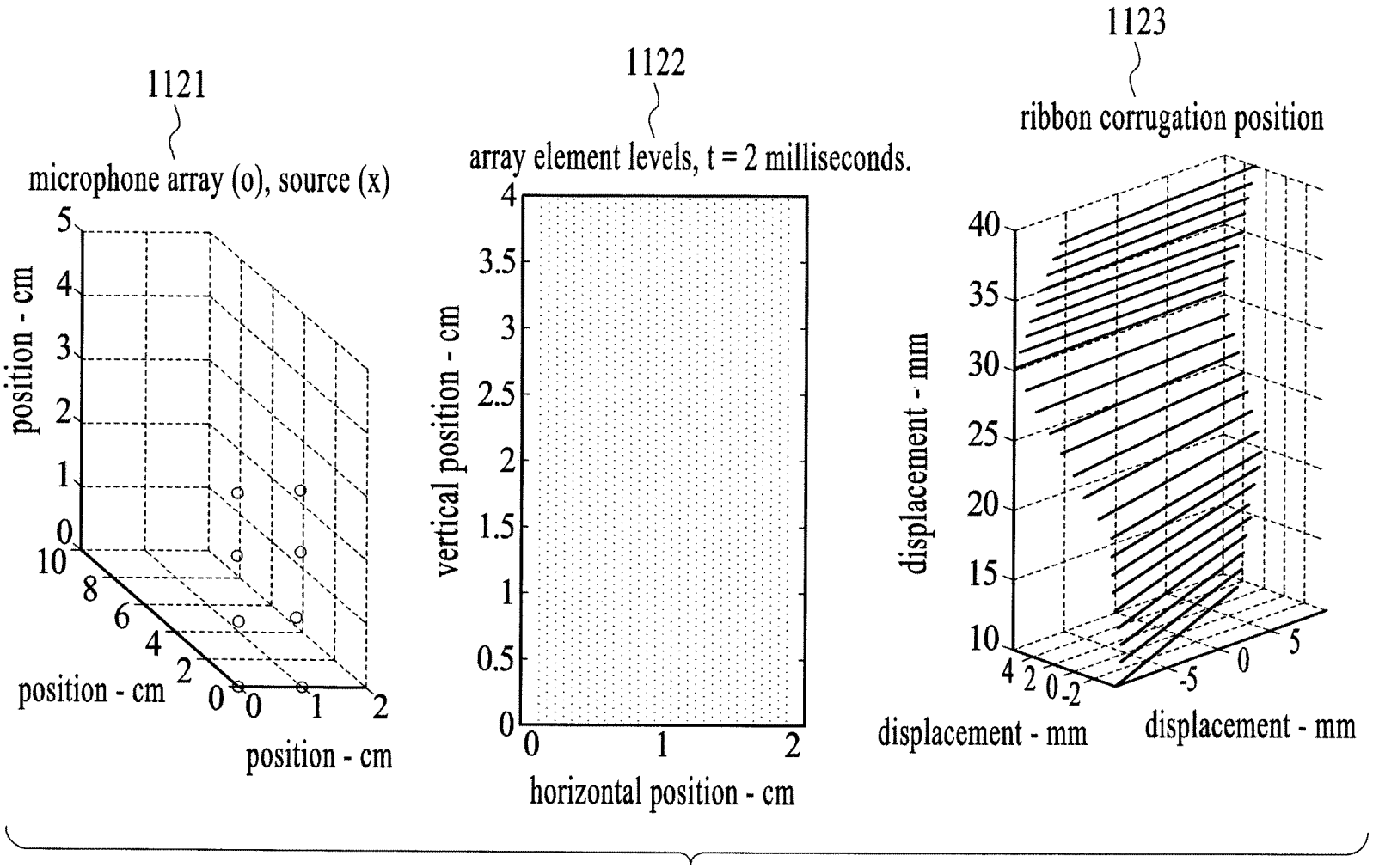
FIG. 4 illustrate example simulated results according to an approach of the invention.
Figure 5A:
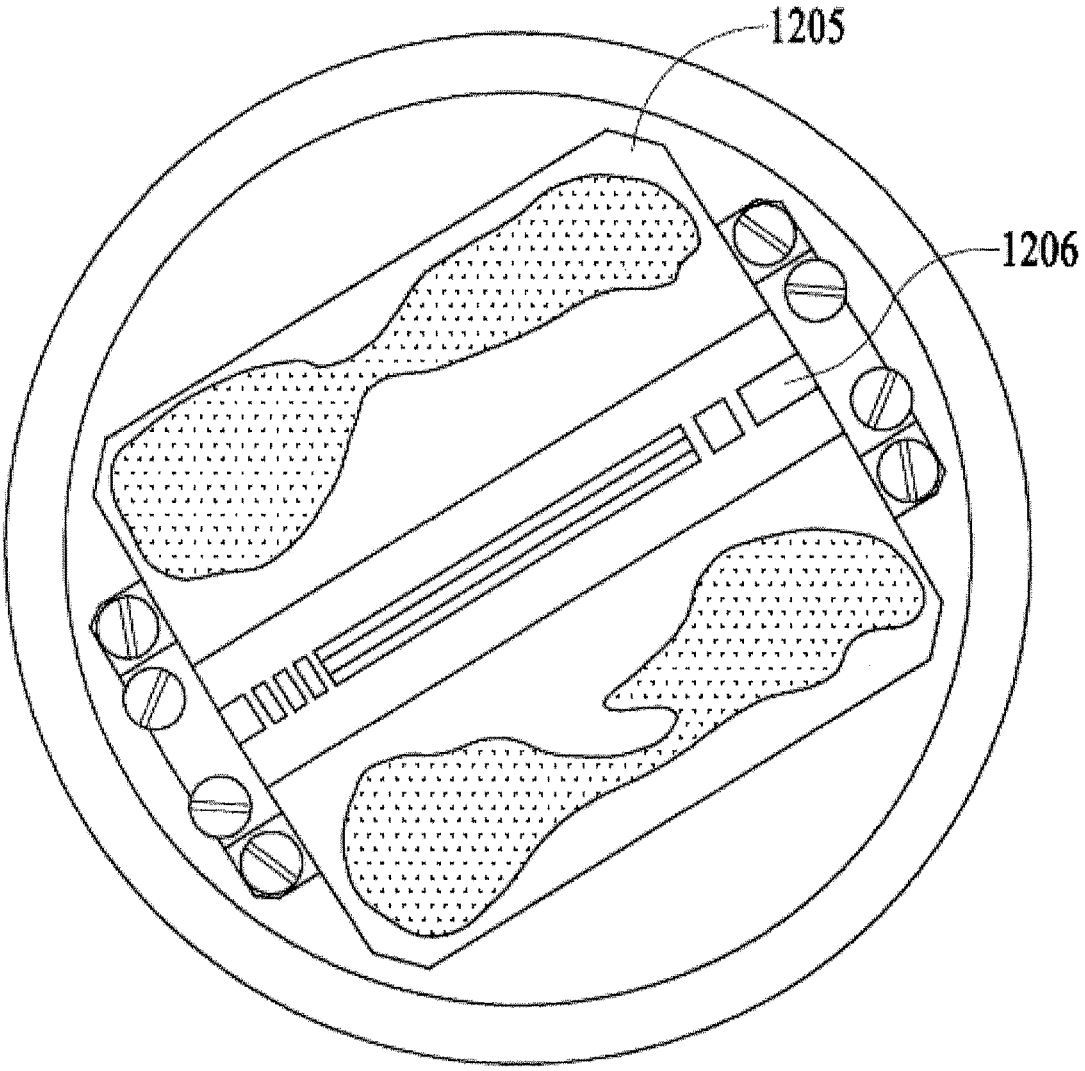
FIG. 5A (PRIOR ART)
FIGS. 5A and 5B illustrate aspects of conventional ribbon microphones.
Figure 5B:
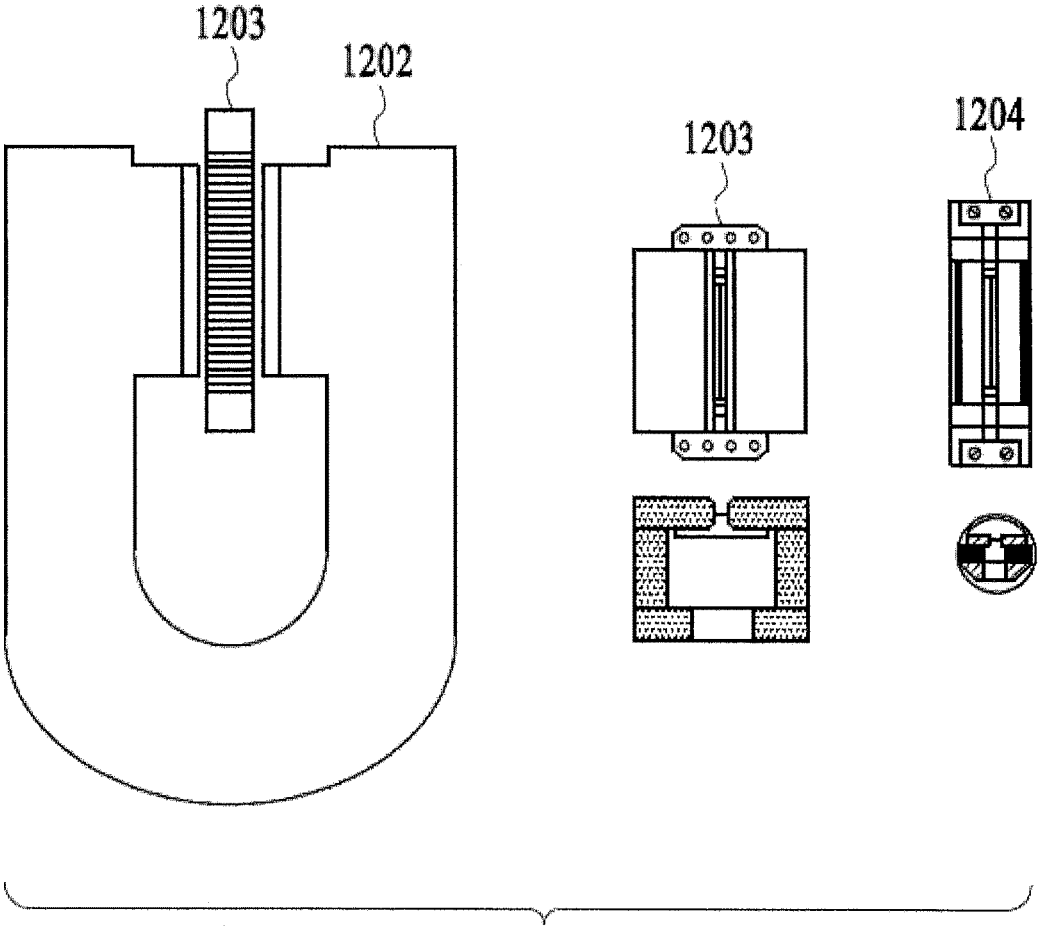
FIG. 5B (PRIOR ART)

FIG. 4 is a diagram illustrating a simulated output of the microphones 1121 in response to sound field arriving at a given frequency and amplitude 1122, and a simulated motion of the ribbon shown in 1123.

So, according to general aspects, embodiments of the invention aim to produce a ribbon microphone that is mechanically and acoustically robust using an array of conventional microphones that are known to be durable.

The following sections provide more detail about various aspects of the invention.

Figure 6A:
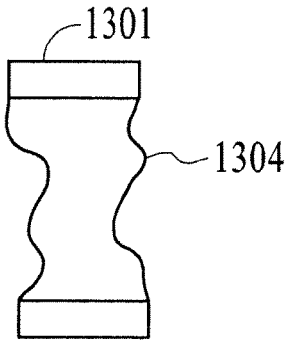
FIGS. 6A to 6I illustrate aspects of an emulation approach according to the invention.
Figure 6B:
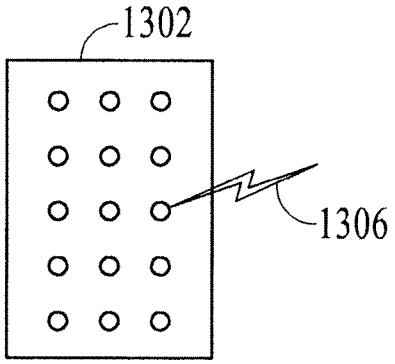

FIG. 6A illustrates certain aspects of the invention. As shown, ribbon microphone 1301 has a displacement 1304 as a function of position along the ribbon of $\Psi$ (x, t). FIG. 6B shows an array of microphones 1302 that is discretized and the microphone signals 1305 $\mu_{ij}$ (t), are the output signals. So, embodiments of the invention use the microphone array signals to drive a waveguide emulation of the ribbon motion. And, then the ribbon displacement is translated into the microphone output according to its motion in a magnetic field.

Figure 6C:
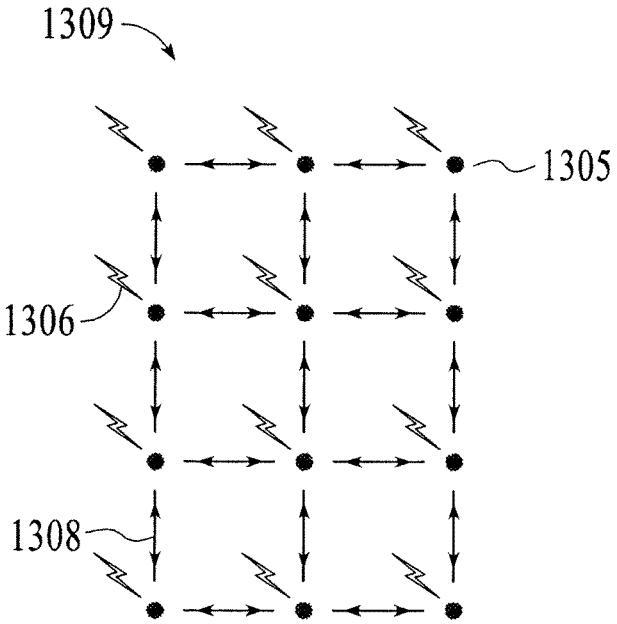
Figure 6D:
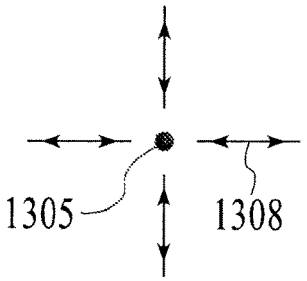

This procedure is illustrated in a little more detail in FIG. 6C. As shown, the waveguide mesh 1309 consists of a set of scattering junctions 1305. As shown in more detail in FIG. 6D, the scattering junctions are connected via bidirectional delay lines 1308, and the signals at the scattering junctions will propagate, essentially according to a discretized wave equation. The wave equation will be propagating $\Phi_i$ (t), which is the junction displacement in a direction perpendicular to the ribbon. The junctions would be driven. Some or all of the junctions would be driven, either directly or indirectly, by the microphone signals 1306 as shown in FIG. 6C.

Figure 6E:
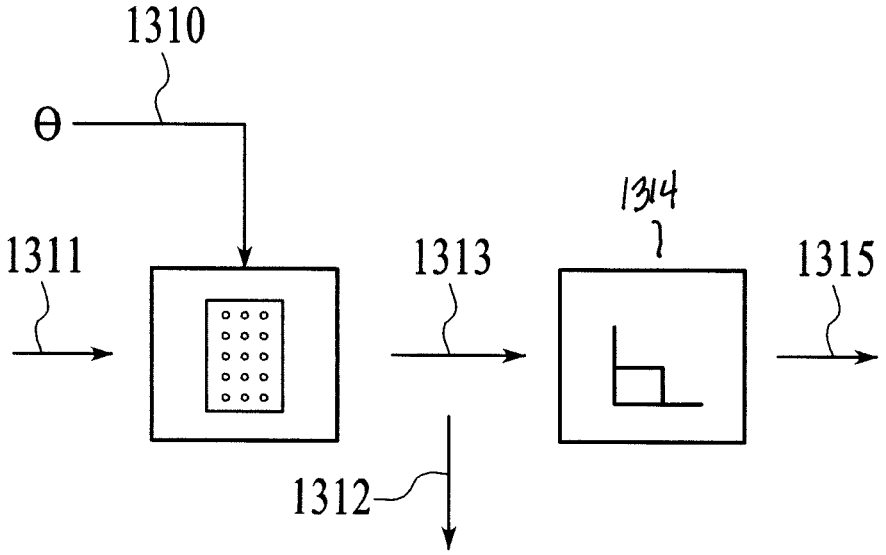

FIG. 6E is a block diagram illustrating example embodiments of the invention. The microphone signals 1311 are combined with mechanical parameters of the ribbon 1310 to produce, perhaps using a waveguide mesh or a finite difference finite element scheme 1312 and then a displacement of the ribbon as a function of position along the ribbon in time is developed 1313. The displacement processor 1314 takes that displacement, takes into consideration the magnetic field and circuitry around it and produce an output 1305.

It should be noted that finite differences or other methods might be appropriate for wave field simulation. In other words, simulation of that ribbon motion. It should be further noted that mesh geometry is not necessarily identical to the microphone array geometry. The microphone signals may be preprocessed to generate inputs for the waveguide mesh at the locations associated with the mesh junctions.

Figure 6F:
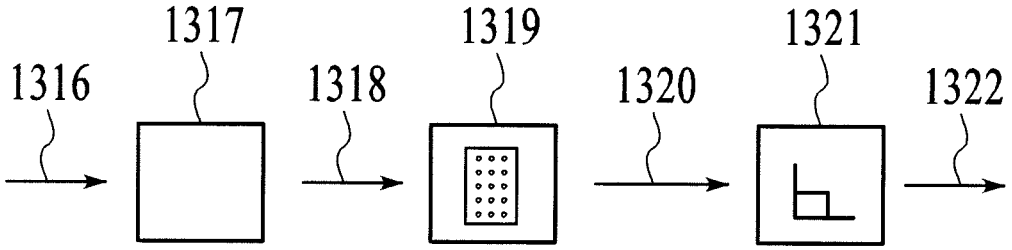

For example, as shown in FIG. 6F, 1316 is the microphone input, 1317 is a preprocessor, 1318 generates $\mu$ (t) which then drives waveguide mesh 1319 to produce 1320 the displacement as a function of ribbon position and time and then into the displacement processor to produce the ribbon output 1322.

It should be noted that nonlinearities may be introduced into the waveguide mesh wave propagation and/or conversion of the wave field to the microphone signal r (t) for purpose of more accurately emulating the ribbon output geometry, acoustic or other effects or other purpose. Note that using, for instance, sample and hold methods analog implementations should be possible. Chip implementation should also be straightforward. One possible drawback to this approach is that if you have a number of microphones you would have to digitize all of the microphone signals and do the processing digitally. Processors are pretty cheap but the high quality conversion needed by professional audio persons could be expensive, so an analog implementation might provide an inexpensive alternative and the waveguide mesh and finite difference schemes would be via sample and hold type approach be amenable to an analog-type implementation. Also, a direct chip implementation would be possible.

By adding an accelerometer, for instance, oriented in the plane perpendicular to the ribbon, the modeled ribbon displacement $\Phi_{ij}$ (t) can be made to account for a mechanical shock to the microphone. It also can determine the direction of gravity. It turns out that the ribbons are suspended under very little tension and will sag under gravity causing the sonic characteristics to change just ever so slightly depending on basically the ribbon, depending on its orientation, will be in a different place in the magnetic field and/or perhaps under slightly different nominal mechanical position and as a result, the character of the sound might change a little bit.

Figure 6G:
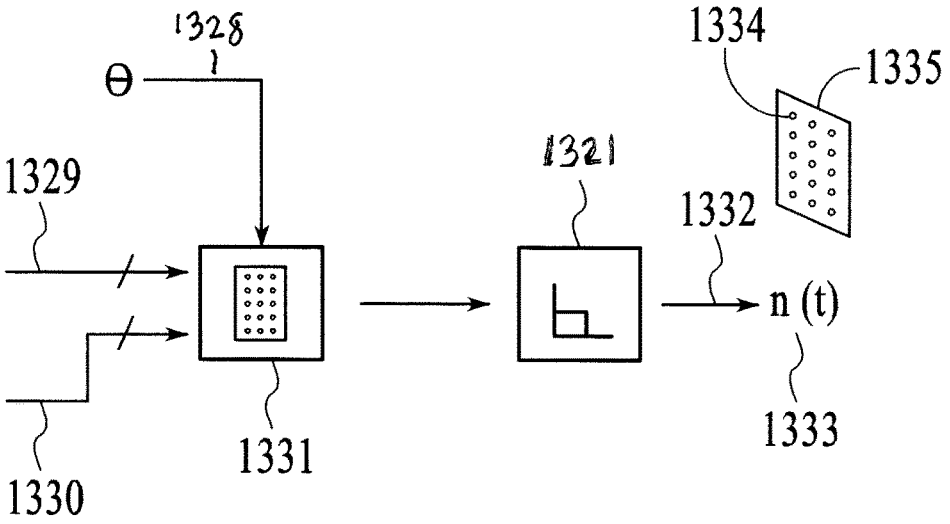

For example, as shown in FIG. 6G, microphone signals 1329 are combined with accelerometer information showing displacement or rotation orientation that's being combined with the ribbon characteristics 1328 in the wave propagation processor 1331 which drives the displacement processing 1332 to produce a ribbon signal 1333. The microphone array 1335 and accelerometer 1334 are shown as well.

Figure 6H:
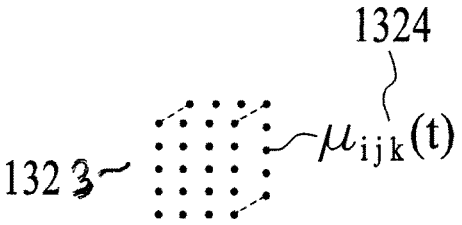

FIG. 6H shows 3-dimensional microphone array 1323 producing microphone signals $\mu_{ijk}$ (t) 1324. Having a 3-dimensional microphone array (e.g., made out of two planes of microphones) would allow the wave simulation to drive its input from the actual spatial location of the impinging sound field. In other words, if the ribbon is moving around, and if it is desired use the differential pressure on either side of the ribbon at a dense sampling across the ribbon to drive the motion, then by having a 3-dimensional array one can actually drive the motion of the array according to the sound field at the position that the ribbon would be taking on at the time.

Figure 6I:
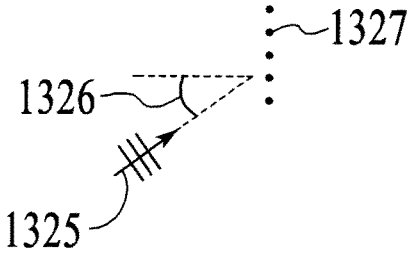

FIG. 6I shows a wave 1325 coming in at an angle 1326 to a microphone array 1327. If the array elements arranged roughly in geometry of the ribbon microphone, the antenna pattern of the ribbon microphone can be approximated. So if the array geometry takes on roughly the size and shape of the actual ribbon and then that array of microphones is suspended in a similar housing to that used by the ribbon, the microphone signals that are output will be able to closely approximate the antenna pattern and the like associated with the ribbon.

It should be noted that the combining of many microphone signals and the spatial processing (smoothing) of the wave propagation should produce an output r (t) with noise significantly reduced compared to that of an individual element. One beneficial aspect about ribbons is that they are pretty low noise. They don't produce a lot of signals so there is some noise in terms of the amplification but there's not a lot of noise caused by just random collisions of air molecules against the ribbon because the ribbon covers a significant area. Conversely, if there is just a single very small microphone, it's going to generate not a lot of noise. But if there is a whole array of microphones there's going to be a lot of spatial averaging going on and they would likely be relatively noise-free as a result.

The following discussion provides additional details of ribbon dynamics emulation.

Figure 7A:
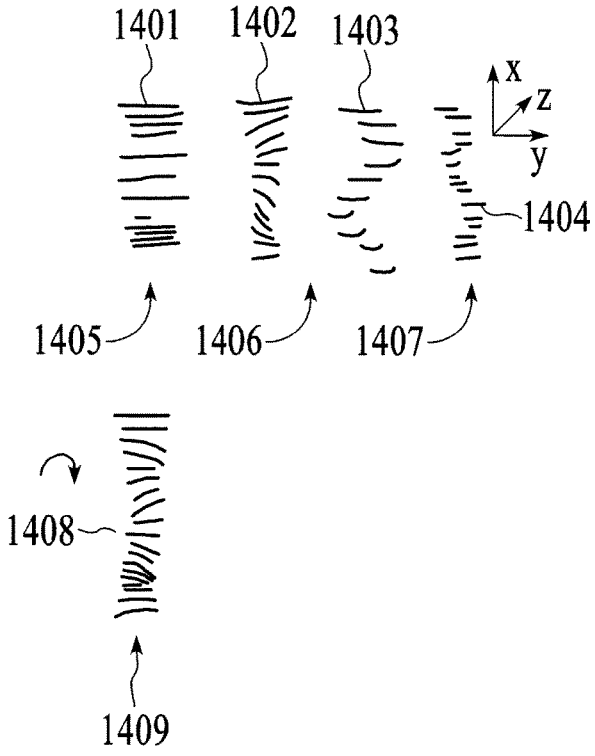
FIGS. 7A to 7F illustrate further aspects of an emulation approach according to the invention.

FIG. 7A illustrates a rather simple model for the ribbon motion in response to measurements of the sound field at the microphone array. In particular, it provides a set of propagation modes. As mentioned above, the ribbon is a thin strip of corrugated aluminum. There are a number of propagation modes that are associated with the corrugations getting compressed or relaxed, like an accordion. That is shown by 1401. Those are longitudinal displacements. There also might be tortional waves where the corrugations rotate relative to the axis of the ribbon, that's shown by 1402. Drawing 1403 illustrates a transverse displacement in the direction parallel to the corrugations. Drawing 1404 shows a transverse displacement perpendicular to the corrugations, front to back as drawn in this diagram, with the corrugations being tilted relative to the axis. That's further illustrated in 1408 and given a label Φ 1409. Other motions are unlikely to be excited. The corrugations add a little bit of strength and one would not expect the ribbon to bow around those axes, and laser vibrometer measurements indicate that transverse motion in the x direction 1404, and tortional motion as seen in 1402, the θ direction 1406. There is likely some longitudinal motion as well.

The present inventor performed laser vibrometer measurements using a conventional ribbon microphone. These measurements did not show any bowing of the ribbon so these modes should capture the essential behavior. They didn't show any tilt of the ribbon in response to a sound field. In general, the set up of the laser vibrometer included a speaker on axis, there were some off axis measurements made, but mostly there was a speaker and a ribbon microphone, and the laser vibrometer was able to detect the response of the ribbon microphone to assign each acoustic field as a function of the frequency of the sound wave.

The main modes that were seen from these measurements were 1405 *z*, slightly; 1406 θ, most definitely; and the x direction, shown as 1404 in FIG. 7A. So in embodiments of the invention, the main ones to simulate are the 1404 and 1402 directions, and to a modest extent 1405. Direction 1401 might be involved as well. In order to model this, instead of having a waveguide mesh or finite element finite difference scheme which tries to estimate the motion for a large grid of points, two models were contemplated by the present inventor. One model had two sets of parallel spring mass, akin to an unrolled DNA, or an untwisted DNA kind of strand with bars in between. This is illustrated and described in more detail below.

Figure 7B:
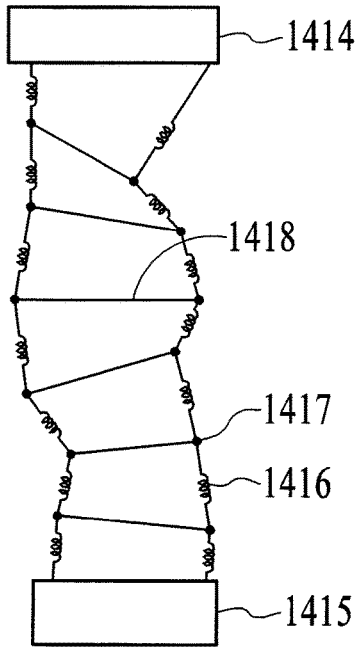

FIG. 7B shows one example model where 1414 and 1415 are the mounts of the ribbon. The ribbon model includes masses 1417 and connecting the masses are springs 1416. There are two rows of the masses and springs and they are connected of the bars at 1418 and there are equations of motion that describe how the springs and masses respond to input driving forces, and these are relatively simpler than having a two dimensional grid or even three dimensional grid of waveguide mesh or finite difference finite element points.

Figure 7C:
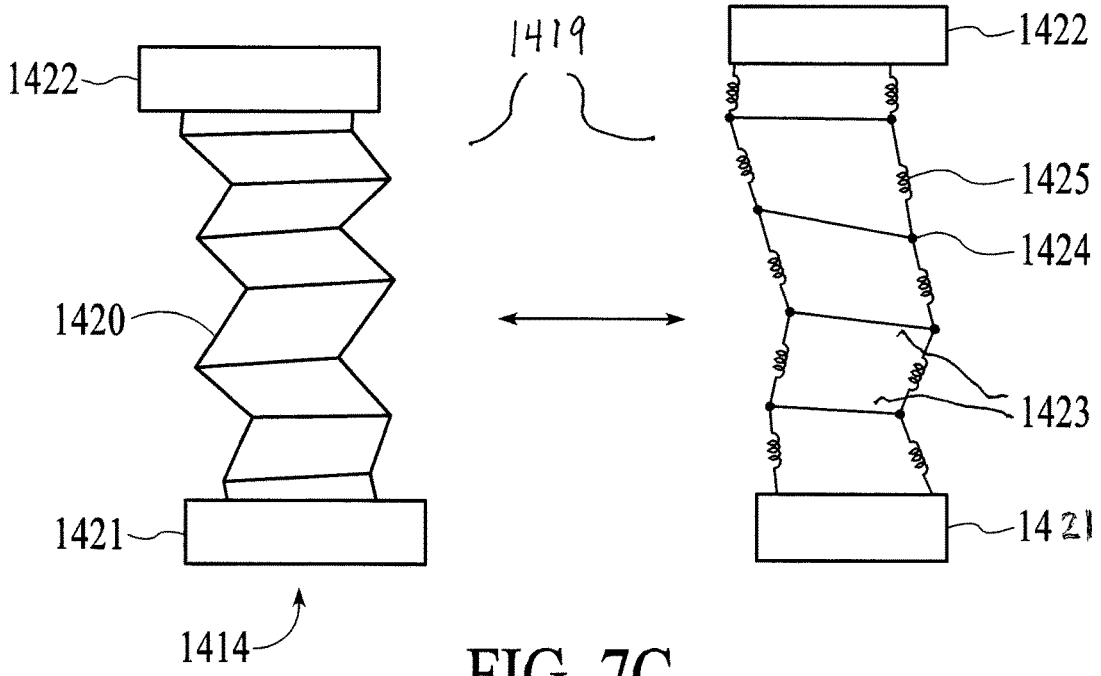

FIG. 7C further illustrates an example model of ribbon microphone 1419. There 1421 and 1422 which are the mounts and then the corrugations are shown 1420. So, in this one model in the motion model on the right, 1424 and 1422 are the equivalents of the mounts and then there a set of springs 1425, the masses are 1424 and the rigid bars connecting the masses are 1423. There could be different spring constants along the spring. The masses could also be weighing different amounts along the spring, etc.

Figure 7D:
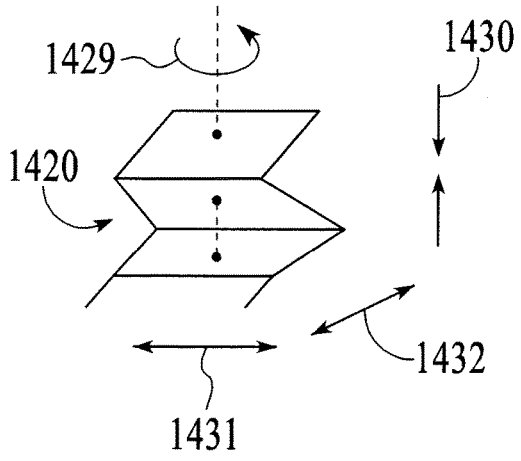
Figure 7E:
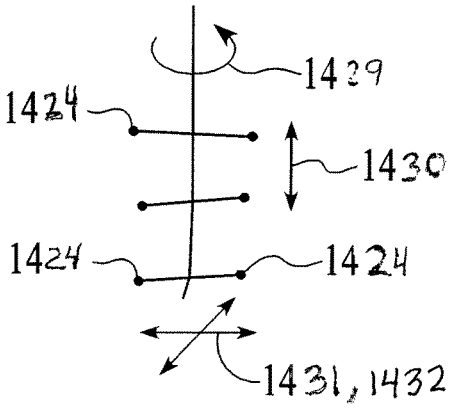

FIG. 7D illustrates behavior of corrugations 1420 of the spring in this model. The corrugation can expand or contract, or can be caused to be opened or closed, so there could be motion of that corrugation about an axis through the center of the ribbon and there can be an axis of rotation 1429. There can be displacement 1430 by the corrugations expanding or contracting. There can be displacements 1431 side to side, or displacement 1432 front to back. Displacement 1431 has not been observed in the laser vibrometer or other measurements. So, an alternative model to the untwisted DNA type model is to have a single set of springs and masses with a spring constant, in other words a set of springs and masses which will control any transverse or longitudinal displacements. Then the springs would have separate tortional and transverse and longitudinal spring constants and arranged in a kind of fish spine with other fish bones coming off of it, as illustrated in FIG. 7E. This is a variation of the model in FIG. 7C, which includes parallel springs and masses, whereas FIG. 7E includes inline springs and masses with tortional displacements.

In both cases, however, the relative moment of inertia can be controlled. There can be separate constants controlling the tortional spring constant and the vertical and longitudinal spring constants in case there are two sets of masses and springs in parallel with the stiff bars, the relative tortional and transverse longitudinal resonants, etc. can be controlled by choosing the width of the bars.

Figure 7F:
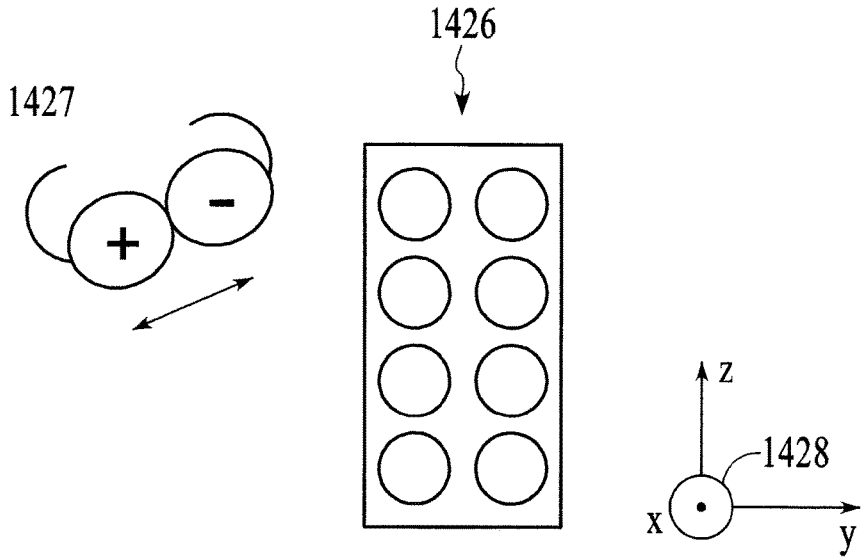

FIG. 7F illustrates a microphone array that implements a model such as those described above. As shown, it includes set 1426 of microphones matching on a block, which could either be pairs of omnidirectional microphones or microphones with a dipole pattern. The dipole pattern is shown in 1427. FIG. 7F shows coordinate system 1428. Example implementations directly drive the ribbon mic segments, such as 1439, 1438 in FIG. 7E, using the microphone element outputs.

The following descriptions explain example mathematics for converting the measured microphone signals into ribbon motion.

Figure 8A:
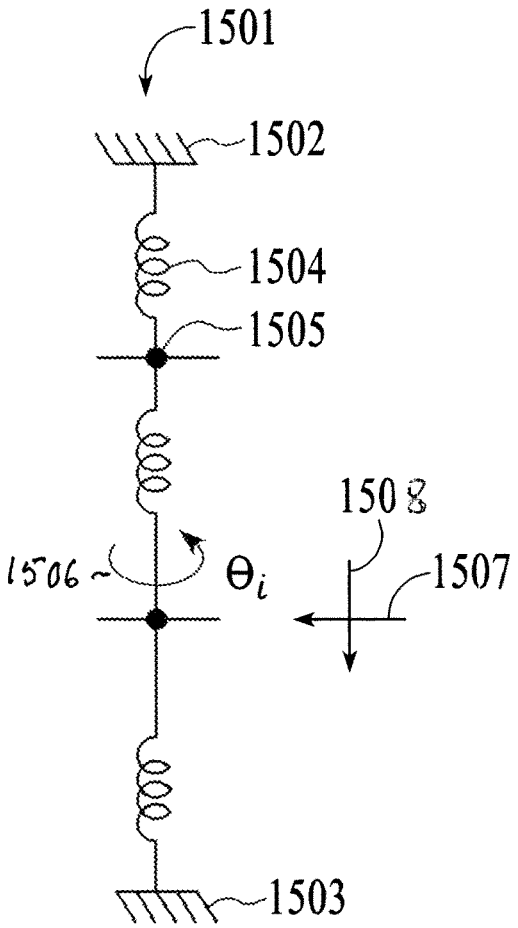
FIGS. 8A and 8B are diagrams illustrating mathematical models used in emulation approaches according to the invention.

In FIG. 8A illustrates a ribbon model 1501 which is a spring mass model. There are two dummy masses $x_0$ and $x_n$ which are at positions [0, 0] and [n, 0]. The first position being the vertical displacement and the second element being the horizontal displacement. There is placeholder $x_n$, n being one more than the number of masses 503, and that is at a zero horizontal displacement and is offset by an amount D 1530. D is the separation between the ribbon supports. It is preferable to have one mass per ribbon corrugation although the two do not necessarily have to be related. So, there are a set of springs 1504 and masses 1505. The masses can take on a position with two elements, a vertical displacement $x_1$ 1503 and $x_2$ a horizontal or transverse displacement 1507. They can also take on a rotation 1506.

In FIG. 8A, the transverse and longitudinal displacements are represented by x. The rotational state is represented by θ. So, there are two equations of motion. One for the transverse and longitudinal displacements of the masses, i.e., corrugations, and there is another equation for the tortional displacement of the corrugations. The equation of motion, the corrugation mass m and the $i^h$ corrugation experiences an acceleration as described in the following equation:

$$m_x\ddot{x}_i=F_{i,i+1}+F_{i,i-1}+m_x g\eta(\varphi)-\gamma\dot{x}_i-\alpha\cdot[\dot{x}_{i+1}-\dot{x}_i+\dot{x}_i-\dot{x}_{i-1}]+$$

$$\lambda\sim\mu_i\cdot\begin{pmatrix}0\\1\end{pmatrix}$$

This acceleration equals the forces acting on it from the previous corrugations, spring constants $F_{i,i+1}$ and $F_{i,i-1}$, and gravity. The gravity term g is the gravitational acceleration, and m is the mass of the segment. The term g has an associated vector $\eta(\varphi)=[\cos\varphi, \sin\varphi]$, which is the orientation of the ribbon with respect to gravity. Also in the equation of motion are two terms that produce losses, one is a viscous drag term $\gamma\bullet x_i'$ and another is thermal losses $\alpha\bullet[x_{i+1}'-x_i'+x_i'-x_{i-1}']$ that happen in the material. In addition to those terms there is a forcing term $\lambda\bullet M_i$. This accounts for the fact that the differential sound pressure front to back of the microphone will cause displacements in the direction perpendicular to the axis of the ribbon.

Figure 8B:
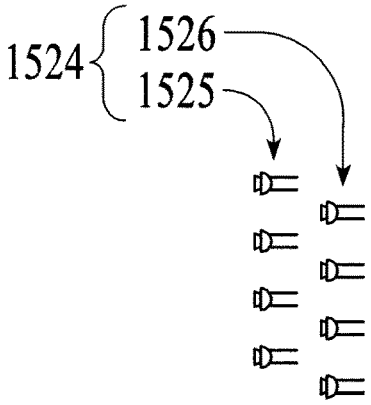

As shown in FIG. 8B, the transverse force is derived from signals at the elements of the microphone array 1524. These represent the microphone signals in a preferred arrangement. There are a number of microphone signals 1525, 1526 in two rows, one of them is $m_{i,0}$ and the other is $m_{i,1}$ for the left and right side of the ribbon, respectively. Preferably the microphones are either themselves have a substantially dipole figure of eight style antenna pattern/polar pattern or they are made up of two elements that can be different to form such a polar pattern. The sum of the left and right microphone element signals 1525, 1526 is the applied force transverse to the ribbon, whereas the difference between the signals at the microphones would be a torque that gets applied causing the ribbon to twist. The torque is therefore given as: $\tau_i=m_{i,1}-m_{i+1}$ whereas the transverse force is given as: $\mu_i=m_{i,1}+m_{i+1}$.

The force due to the spring constant between adjacent corrugations is shown in the following equation and it's a function of the spring constant u:

$$F_{i,i\pm1}=u(\|x_i-x_{i\pm1}\|-l_0)\cdot\frac{x_{i+1}-x_i}{\|x_i-x_{i\pm1}\|}$$

As seen, it basically is the spring constant u times the displacement of the masses relative to a nominal displacement labeled here $l_0$. And, the direction that the force is applied is the difference in position of the two masses normalized by their distance. So, putting all of this together you have the following equation which expresses the transverse and longitudinal displacement of the ribbon as a function of gravity and the applied acoustic forces.

$$m_x\ddot{x}_i+\gamma\dot{x}_i+a_x\cdot\left[\dot{x}_{i+1}-\dot{x}_{i-1}\right]+u_x\cdot\left(1-\frac{l_0}{\|x_i-x_{i-1}\|}\right)\cdot(x_i-x_{i-1})+$$
$$u_x\cdot\left(1-\frac{l_0}{\|x_i-x_{i+1}\|}\right)\cdot(x_i-x_{i+1})=m_x g\eta(\varphi)+\lambda_x\cdot\mu_i\cdot\begin{pmatrix}0\\1\end{pmatrix}$$

The tortional displacement of the ribbon is found in a very similar way, and is shown below:

$$m_\theta\ddot{\theta}_i+\gamma\dot{\theta}_i+\alpha_\theta\cdot[\dot{\theta}_{i+1}-\dot{\theta}_{i-1}]+u_\theta\cdot(\theta_{i+1}=2\theta_i+\theta_{i-1})=\lambda_\theta\cdot\tau_i$$

This is a little bit simpler and there are the same sort of acceleration and dampening terms $m\bullet\theta_i''$, $\gamma\bullet\theta_i'$ and $\alpha\bullet[\theta_{i+1}'-\theta_{i-1}']$. There is a tortional spring constant u to go along with a sort of a second difference in tortional displacement about the element $(\theta_{i+1}-2\theta_i+\theta_{i-1})$. Again, that's driven by the differential pressure of the microphone according to a coupling constant λ.

So, these are a set of continuous time differential equations relating motion at a set of discrete points and they can be discretized by a linear transform.

For example, there can be a second order multi variant system where you have a matrix times x", a second derivative plus another matrix times x' plus a third matrix times x equals β, where x in this case is the displacement at a set of points. The displacement of each of these masses and both of the equations above can be put into that form once all of the equations for each of the masses is considered. Going from the continuous time equation for motion to a discrete time equation can be done by substituting the derivative represented by s for 2/t, t being a sampling period times (1−ξ) minus one the unit delay operator over one plus the unit delay operator. Doing a little algebra and arranging terms yields the following equation $$x(t)=(v^2A_2+vA_1+A_0)^{-1}\bullet[\beta(t)+2\beta(t-1)+\beta(t-2))+2(v^2A_2-A_0)\bullet x(t-1)-(v^2A_2-2vA_1+A_0)\bullet x(t-2)]$$

This equation expresses x at discrete time t as a function of the driving function at times t, t−1 and t−2 and the displacements at time t−1 and t−2. So, given the current and past couple inputs and state of motion, one can compute the next set of positions of the ribbon variable. Preferably a matrix inversion is performed at the very first term in the above equation and that matrix inversion turns out to be relatively straightforward as the matrix is a tridiagonal matrix for both the longitudinal, transverse displacement and the tortional displacement.

The following in connection with FIGS. 9A to 9G discusses an example implementation of the ribbon array emulation using analog circuitry rather than digital processing techniques. One advantage is that it is not necessary to discretize the microphone array outputs and it is possible to get a more accurate simulation of the preamp circuitry and the transformer output because an actual transformer can be used. A drawback might be that the emulation might not be as easily tuned to a particular microphone configuration.

Figure 9A:
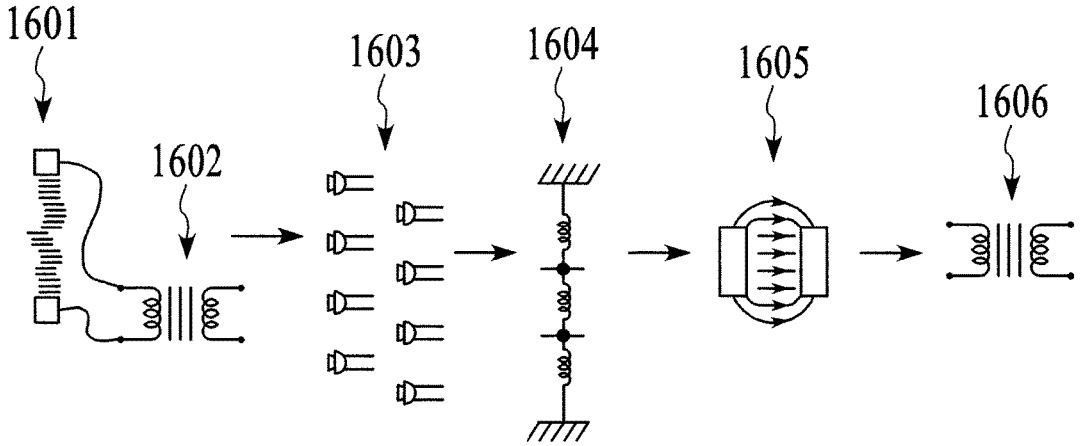
FIGS. 9A to 9G illustrate aspects of implementing the emulation approach of the invention using analog components in embodiments of the invention.

One basic approach is described in FIG. 9A. An aspect of this approach to ribbon microphone emulation is to improve robustness while retaining the sonics. As shown, a ribbon 1601 and a transformer output 1602 are emulated by a array of microphones 1603 to generate an estimate of the ribbon motion 1604 which drives a simulation of the electromagnetics 1605 and output 1606. The motion of the ribbon, it turns out, is mainly along two axes, one is transverse to the ribbon and the other is tortional twisting of the ribbon around its axis. This was shown in laser vibrometer measurements performed by the present inventor and an aspect is that each of these motions is equivalent to a spring mass system.

Figure 9B:
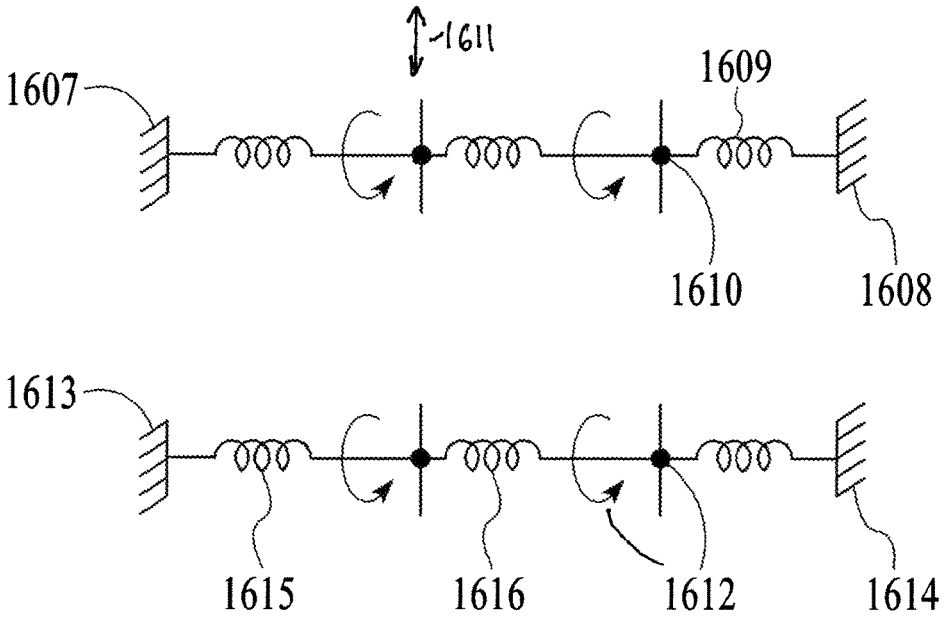

As shown in FIG. 9B, ribbon motion emulation accounting for the transverse displacements includes a set of springs and masses. Masses 1610 and springs 1609 are anchored at opposite points 1607 and 1608. This model is sufficient to model the transverse displacement 1611. The tortional displacement 1612 can be modeled by a set of springs 1615 and masses or moments of inertia 1616. Springs 1615 can have different spring constants. Again, the ribbon in this model is anchored at 1613 and 1614.

Figure 9C:
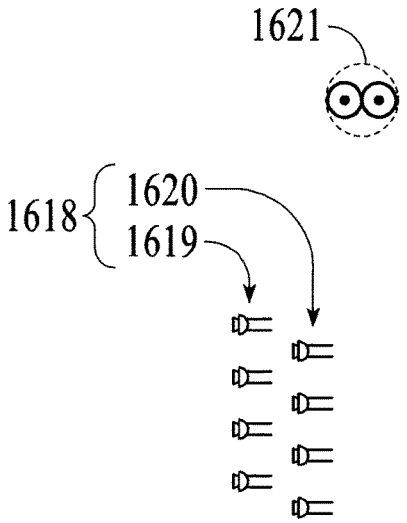

As shown, the dynamics can be simulated using the spring mass, one spring mass pair preferably per ribbon corrugation. The position and rotation of these masses and spring mass models can be driven by microphone signals. There can be a couple rows of microphones. This is shown in FIG. 9C in which microphone sum and difference signals drive the transverse and tortional displacements represented in the equations above. For example, microphone array 1618 includes microphone elements that preferably have polar patterns 1621 that are figure of 8 style, dipole type style polar patterns. One could add or one could take the sum or difference of the pairs of microphones in each row to generate the signals that drive the transverse displacement or the tortional displacement of the ribbon. In the spring mass model of the tortional or transverse modes, each spring and mass can be characterized by a resonant frequency and a dampening. For instance, as can be derived from the equations above, a spring and mass would be analogous to a RLC circuit in a transmission line.

Figure 9D:
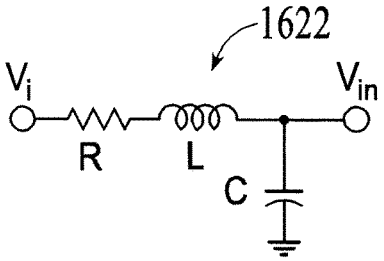

There are various techniques known in the art that take spring mass systems and derive an equivalent acoustic system and equivalent electrical system. Anyway, as shown in FIG. 9D, there is an RLC circuit 1622, and it has a transfer function which will be a type of resonant low pass filter with a resonant frequency given by the square root of the inductor capacitor product and a dampening given by the resistor capacitor product time constant.

So, the spring mass system which emulates the ribbon motion can be nicely emulated by a transmission line having a set of inductors and capacitors and a small resistance at circuit 1622, one feeding into the next in the transmission line form, and the tortional and longitudinal modes reflecting at the boundaries at the supports could be included as well. In any event, in a simple transmission line with just a couple passive components, if it is not desired to implement inductors there are ways of doing it with capacitors and the like.

Figure 9E:
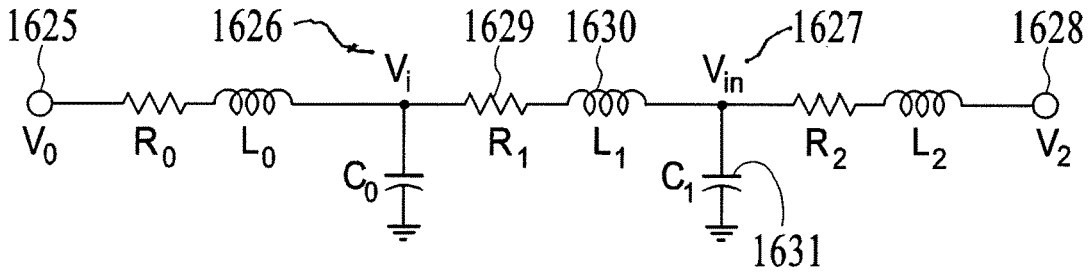

Accordingly, in the circuit shown in FIG. 9E, the voltages 1625, 1626, 1627, 1628 appear from a two element transmission line.

Figure 9F:
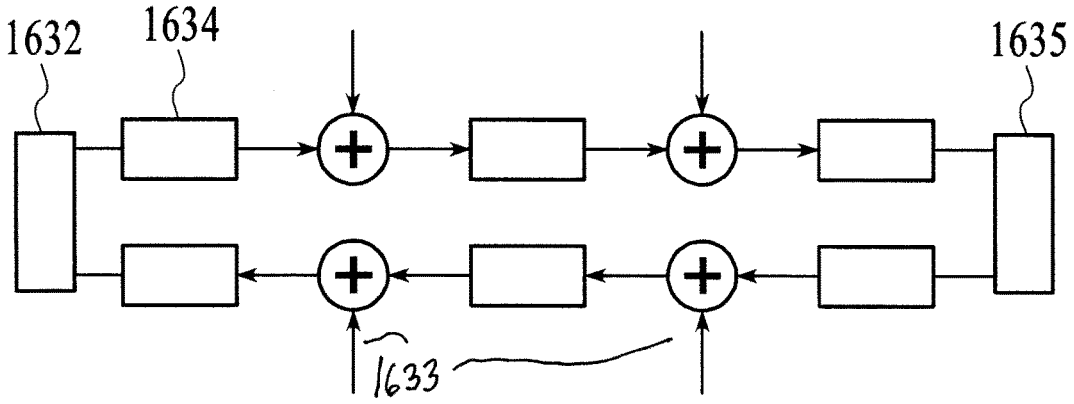

Correspondingly, FIG. 9F shows a transmission line which implements the displacement, which when driven at the various junctions, can emulate the tortional or transverse displacement or longitudinal displacement of the ribbon in response to arriving sound. What happens, as described above, is that the microphone signals can be summed into the transmission line junctions, similar to what is done in a waveguide with elements 1632, 1633, 1634 and 1635, etc. The sum or difference signals of the microphone signals can be fed into the respective transmission lines and then propagation happens automatically. The various positions of the masses which would be represented by voltages, and which in turn would be represented by the capacitor voltages, can then be extracted here in and used to drive emulations of the electromagnetics. So here the motion of the ribbon in a magnetic field will translate into a voltage across the terminals and in a fairly straight forward way. For example, the voltage can be expressed as the cross product:

$$V = dx/dt \; X \tau_s$$

Where dx/dt is the displacement, and $\tau_s$ is the magnetic field.

Figure 9G:
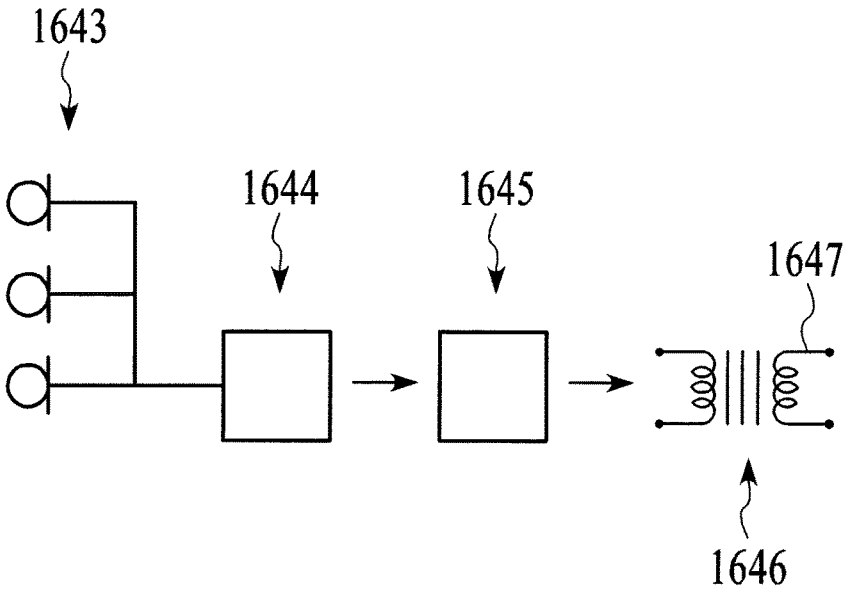

This output can drive a transformer or whatever similar output electronics are present, as shown in the example of FIG. 9G. According to certain aspects, it can be a lot more convenient and a lot less expensive to implement all of this in analog rather than digitizing it, and in the end you're left with a microphone which is robust to mechanical shock and can be used in high volume acoustic context and still retains the character of a ribbon microphone.

In summary, the above descriptions show how aspects of the invention can be implemented using a transmission like structure to emulate the transverse and longitudinal displacement as well as the tortional displacement. From there one can simulate the effect of that motion in a magnetic field and that can drive a transformer at the output. Another thing to note is that inductors, capacitors, and the like, are getting incredibly small and are provided in surface mount. So this might be a very cost effective way of implementing the invention. In other words emulating a ribbon microphone using an array of mechanically and acoustically robust microphones.

The attached Appendix is incorporated herein by reference in its entirety.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. An apparatus, comprising:

a plurality of microphone elements that respectively produce microphone signals, wherein the microphone elements are respectively positioned at identified points of a ribbon microphone; and circuitry that receives the plurality of microphone signals from the microphone elements, produces digitized data of the plurality of microphone signals, and uses an eauation derived from a model of masses located at the identified points of the ribbon microphone and springs connected therebetween to determine a motion of the ribbon microphone based on the digitized data of the plurality of microphone signals and to produce an output signal using the determined motion.

2. The apparatus of claim 1, wherein the microphone elements comprise an array of miniature microphone elements.

3. The apparatus of claim 1, wherein the microphone elements are substantially more mechanically and electrically robust than the ribbon microphone.

4. The apparatus of claim 3, wherein the microphone elements comprise condenser microphones.

5. The apparatus of claim 1, wherein the determined ribbon motion comprises one axis of motion.

6. The apparatus of claim 1, wherein the determined ribbon motion comprises one axis of velocity.

7. A method implemented by a computer, comprising:

identifying a plurality of points of a ribbon microphone;

respectively locating a plurality of microphone elements at the plurality of identified points;

receiving a plurality of microphone signals respectively produced by the plurality of microphone elements;

producing digitized data corresponding to the received plurality of microphone signals;

determining a spring mass model of the ribbon microphone using masses at the identified points of the ribbon microphone and springs connected therebetween;

processing the digitized data corresponding to the received plurality of microphone signals using an equation derived from the spring mass model to determine a motion of the ribbon microphone; and producing an output signal based on the determined motion.

8. The apparatus according to claim 1, wherein the equation produces the ribbon motion as an output based on input terms including one or more of a mass quantity of the masses, a viscous drag term associated with a material of the ribbon microphone, a thermal loss term associated with the material of the ribbon microphone, a spring constant, a nominal displacement, a gravity term, a coupling term, and an acoustical pressure exerted on the ribbon and reflected in the received microphone signals.

9. The method according to claim 7, wherein the equation produces the ribbon motion as an output based on input terms including one or more of a mass quantity of the masses, a viscous drag term associated with a material of the ribbon microphone, a thermal loss term associated with the material of the ribbon microphone, a spring constant, a nominal displacement, a gravity term, a coupling term, and an acoustical pressure exerted on the ribbon and reflected in the received microphone signals.

10. The method of claim 7, wherein the microphone elements comprise an array of miniature microphone elements.

11. The method of claim 7, wherein the microphone elements are substantially more mechanically and electrically robust than the ribbon microphone.

12. The method of claim 11, wherein the microphone elements comprise condenser microphones.

13. The method of claim 7, wherein the determined ribbon motion comprises one axis of motion.

14. The method of claim 7, wherein the determined ribbon motion comprises one axis of velocity.

15. The method of claim 9, further comprising determining certain of the input terms from physical characteristics of the ribbon microphone.

* * * * *